United States Patent [19]

Pim

[11] 4,074,558

[45] Feb. 21, 1978

[54] ROLL CHANGING APPARATUS

[75] Inventor: Norman L. Pim, Salem, Ohio

[73] Assignee: Gulf & Western Manufacturing Company, Southfield, Mich.

[21] Appl. No.: 769,449

[22] Filed: Feb. 17, 1977

[51] Int. Cl.[2] ..... B21B 31/10

[52] U.S. Cl. ..... 72/239

[58] Field of Search ..... 72/239, 238

[56] References Cited

U.S. PATENT DOCUMENTS

| | | | |
|---|---|---|---|
| 3,323,345 | 6/1967 | Lyle et al. | 72/239 |
| 3,559,441 | 2/1971 | Lemper et al. | 72/239 |
| 3,739,618 | 6/1973 | Lemper | 72/239 |
| 3,866,455 | 2/1975 | Petros | 72/239 |
| 3,926,027 | 12/1975 | Krumme | 72/239 |
| 3,979,939 | 9/1976 | Pazdarka | 72/239 |

*Primary Examiner*—Milton S. Mehr

*Attorney, Agent, or Firm*—Meyer, Tilberry & Body

[57] ABSTRACT

A pair of socket members adapted to receive the necks of a pair of mill rolls are mounted on a wheeled carriage for pivotal movement about corresponding horizontal axes perpendicular to the roll axes. The socket opening is of larger diameter than the roll neck and is provided with circumferentially extending diametrically opposed and axially spaced apart upper and lower load bearing surfaces adapted to engage corresponding upper and lower surface portions of the roll neck. The carriage moves the socket members toward the roll necks with the socket members inclined downwardly for the roll necks to be freely received in the socket openings between the corresponding load bearing surfaces. The sockets are then pivoted upwardly for the load bearing surfaces to engage the roll necks and support the corresponding roll as a cantilever. The carriage is then driven to withdraw the rolls from the mill.

22 Claims, 10 Drawing Figures

ROLL CHANGING APPARATUS

This invention relates to the art of rolling mills and, more particularly, to apparatus for inserting and removing mill rolls.

In connection with present day rolling mill operations, traversing carriage type mill roll handling equipment is often used to achieve roll insertion and/or removal. In carriage type roll handling apparatus, a wheeled truck or sled traverses horizontally parallel to the roll axis. Certain previous arrangements have provided for the truck or sled to move beneath a roll and for the roll to be lowered onto the truck and traversed away from the mill stand to a location at which the roll is removed from the truck by an overhead traveling crane. Other carriage type arrangements have provided for the traversing truck to carry clamping or grabbing components which engage a roll end to achieve roll removal and/or replacement.

Carriage type roll handling equipment which traverses beneath rolls in a mill stand requires rails and other special positioning equipment between mill housings, whereby it is difficult to achieve access to these components for purposes of maintenance or replacement. Moreover, lack of accessibility aggravates a further problem with such equipment, namely the fact that frequent and periodic replacement of lining and guiding components are required to maintain proper roll positioning for insertion and removal operations. Still further, special roll chock configurations are often required in connection with such equipment. With regard to carriage type equipment adapted to achieve roll removal through engagement with a roll end, previous efforts have incorporated the use of structurally complex and expensive roll end engaging and roll lifting arrangements, whereby both manufacturing and maintenance expenses in connection with such equipment is undesirably high.

In accordance with the present invention, improved roll end engaging carriage type roll changing apparatus is provided which overcomes or minimizes the problems encountered with carriage type equipment heretofore provided. More particularly, in accordance with the present invention, a traversing carriage is provided with a roll neck engaging member which is pivotal about a horizontal axis perpendicular to the axis of the mill roll. The roll neck engaging member has an axis and is provided with vertically aligned diametrically opposed and axially spaced apart lower and upper load bearing surfaces for respectively engaging diametrically opposed axially spaced apart lower and upper areas of the roll neck.

Preferably, the load bearing surfaces are spaced apart in the direction perpendicular to the axis of the roll neck engaging member a distance corresponding to the spacing between the roll neck portions in the direction perpendicular to the roll axis, and the load bearing surfaces are axially spaced apart such that the distance between axially adjacent ends thereof along a line through the axis of the roll neck engaging member is greater than the perpendicular distance therebetween. This relationship provides for the roll neck engaging member to be tilted downwardly to freely receive the roll neck and then upwardly for the load bearing surfaces to engage the roll neck and support the roll as a cantilever. Further, the carriage preferably supports the pivotal roll neck engaging member such that the axis of the latter is parallel to and spaced slightly above the axis of the roll with respect to the position of the latter axis when the roll is in the mill, whereby pivotal movement of the roll neck engaging member to the position supporting the roll as a cantilever elevates the roll to facilitate axial withdrawal thereof from the mill stand.

The roll changing apparatus of the present invention is structurally simple and manipulation thereof to engage a roll end and support the roll for removal or replacement is likewise simple and enables engagement with and support of the roll to be readily and efficiently achieved. The need for special rails and positioning equipment between mill housings is eliminated as is the requirement for periodic replacement of liners and guidance parts in the mill stand and the elimination of special chock configurations. Moreover, roll handling time in connection with a removal or replacement operation is optimized. Thus, the equipment is economical to produce and maintain and requires less time than heretofore necessary to achieve roll removal and/or replacement and, therefore, is more economical to operate and requires less down time for a mill than with equipment heretofore provided.

It accordingly is an outstanding object of the present invention to provide improved mill roll changing apparatus.

Another object is the provision of mill roll changing apparatus having an improved arrangement for engaging a roll end and supporting the roll by the end during roll changing operations.

Yet another object is the provision of roll changing apparatus of the foregoing character which eliminates the necessity for structurally complex and elaborate clamping assemblies for grasping a roll end.

A further object is the provision of roll changing apparatus of the foregoing character by which engagement and support of a roll is achieved by axial positioning and pivotal movement of a roll end engaging member so that the roll is supported as a cantilever.

Yet a further object is the provision of roll changing apparatus of the foregoing character in which engagement and support of a roll provides for elevation of the axis of the roll relative to the position of the roll axis when supported in a rolling mill.

Still a further object is the provision of roll changing apparatus of the foregoing character which is structurally simple and comprised of a minimum number of moving parts structurally interrelated to function economically during roll changing operations and to provide for construction, maintenance and operation of the apparatus to be more efficient than heretofore possible.

The foregoing objects, and others, will in part be obvious and in part pointed out more fully hereinafter in conjunction with the written description of a preferred embodiment of the invention illustrated in the accompanying drawings in which.

Figure 1:
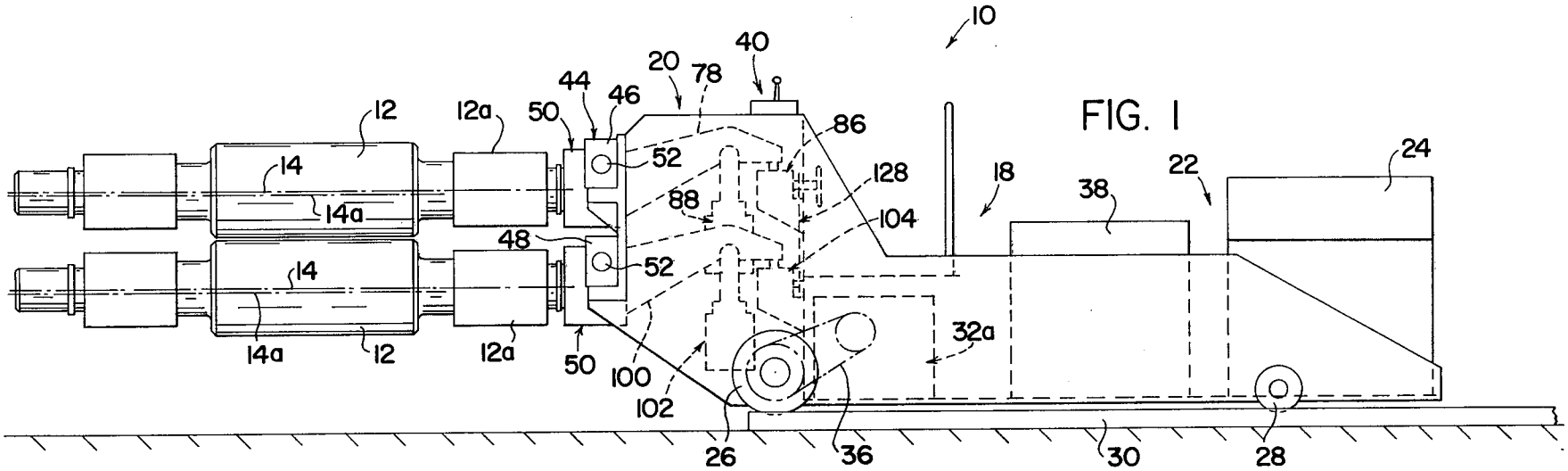
FIG. 1 is a side elevation view of roll changing apparatus in accordance with the present invention.
Figure 2:
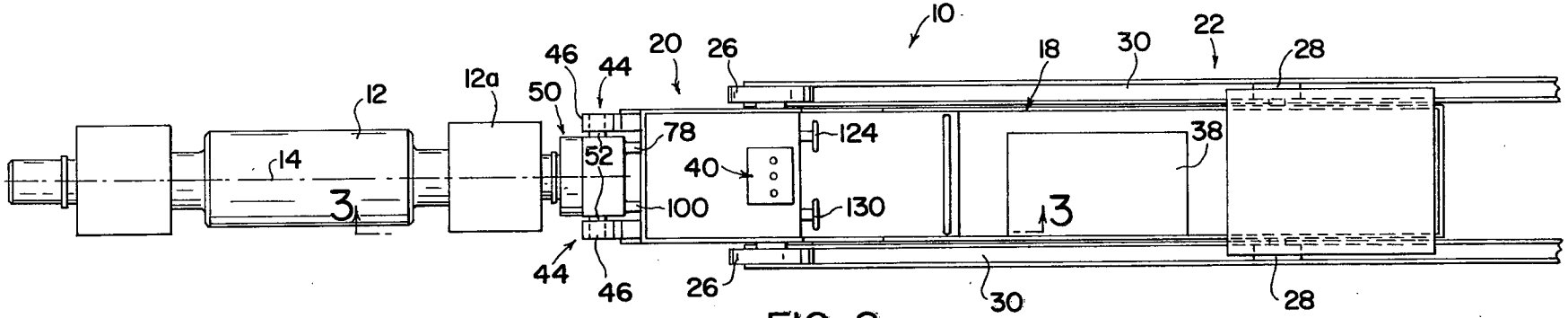
FIG. 2 is a plan view of the apparatus in FIG. 1.

Referring now in greater detail to the drawings wherein the showings are for the purpose of illustrating a preferred embodiment of the invention only and not for the purpose of limiting the invention, roll changing apparatus 10 in accordance with the present invention is shown in FIGS. 1–4 supporting a pair of mill rolls 12 having corresponding roll axes 14 and corresponding roll necks 16 on the ends thereof facing the roll changing apparatus. In connection with the removal of rolls from a mill stand, as will become apparent hereinafter, the roll changing apparatus operates to slightly elevate the axis of a roll from its supported disposition in the mill. In FIG. 1, the components of the roll changing apparatus are illustrated in positions supporting rolls 12 in such elevated relationship, and reference numerals 14*a* represent the location of the corresponding roll axis 14 when the roll is supported in the mill. It will be appreciated that the rolls are rotatably supported adjacent their opposite ends and axially inwardly of the roll necks by suitable chocks 12*a* on the rolls. As is well known, such chocks are received in and supported for vertical adjustment relative to corresponding mill housing windows, not shown. Rolls 12 are engaged and elevated to displace the roll axes 14 upwardly from positions 14*a* to provide vertical clearances, and the rolls and chocks are axially withdrawn through the windows.

Apparatus 10 includes a carriage or truck 18 having a front portion 20, supporting roll end engaging and manipulating assemblies described hereinafter, and a rear portion 22 carrying a suitable counterweight 24 to balance the carriage when rolls are supported at the front end thereof. The carriage is supported for traversing movement axially of rolls 12 by pairs of front and rear wheels 26 and 28 respectively, which ride on suitable guide rails 30. Preferably, the carriage and the component parts of the roll end engaging assemblies are hydraulically actuated and, for this purpose, the carriage carries a suitable hydraulic motor 32 coupled to a suitable speed reduction unit 32*a* having a rotatable output shaft and sprocket wheel arrangement 34 for driving front wheels 26 through chains 36. The carriage also carries a hydraulic supply unit 38, and it will be appreciated that suitable conduits, connections and the like, not shown, are provided for delivering hydraulic fluid between unit 38 and the various hydraulically actuated components of the apparatus. It will be further appreciated that suitable controls are provided for the various hydraulically actuated components and that these controls are manipulatable by an operator for the apparatus from a control station on the carriage such as that schematically illustrated and designated generally by the numeral 40 in FIGS. 1—3.

Front portion 20 of carriage 18 includes a frame plate 42 extending between opposite sides of the carriage and supporting a pair of bracket assemblies 44 adjacent each side of the carriage. Each bracket assembly includes an upper bearing block 46 and a lower bearing clock 48. A roll end engaging member 50, described in detail hereinafter, is disposed between each pair of bearing blocks 46 and 48, and each member 50 is provided with pins 52 received in lined apertures in the corresponding bearing blocks. Accordingly, each roll engaging member is supported for pivotal movement relative to the carriage about a corresponding horizontal axis 54.

Figure 5:
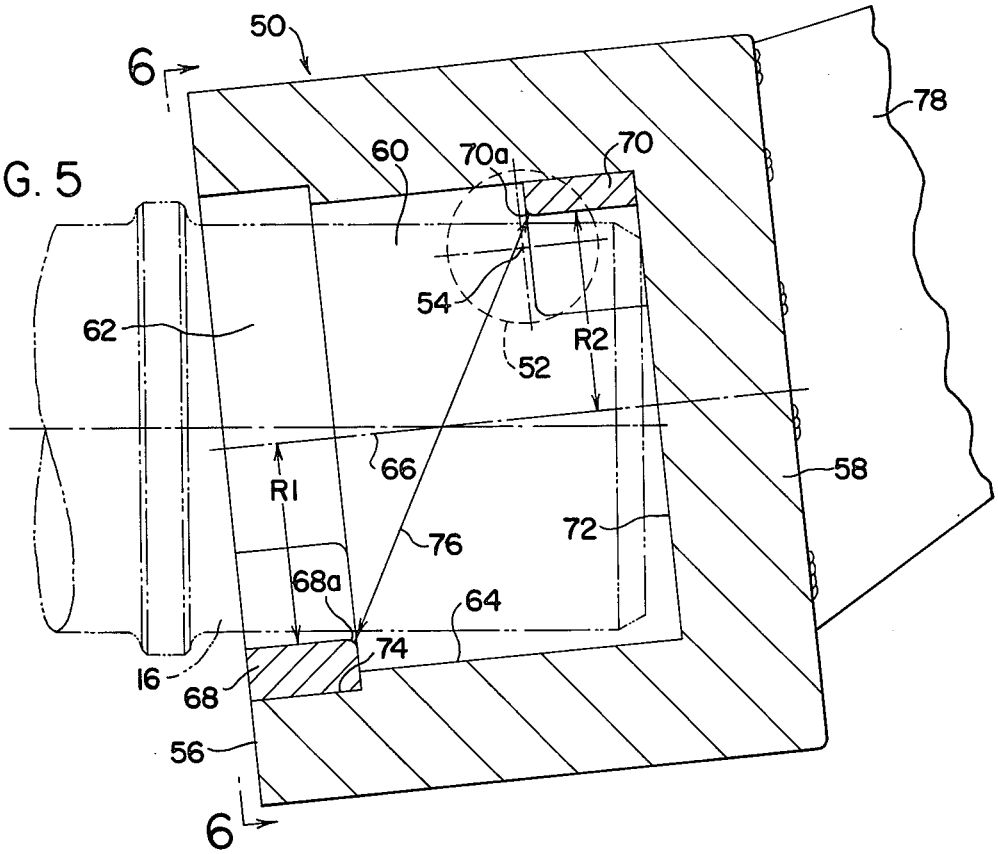
FIG. 5 is a detailed sectional elevation view of the roll end receiving socket member of the apparatus.
Figure 6:
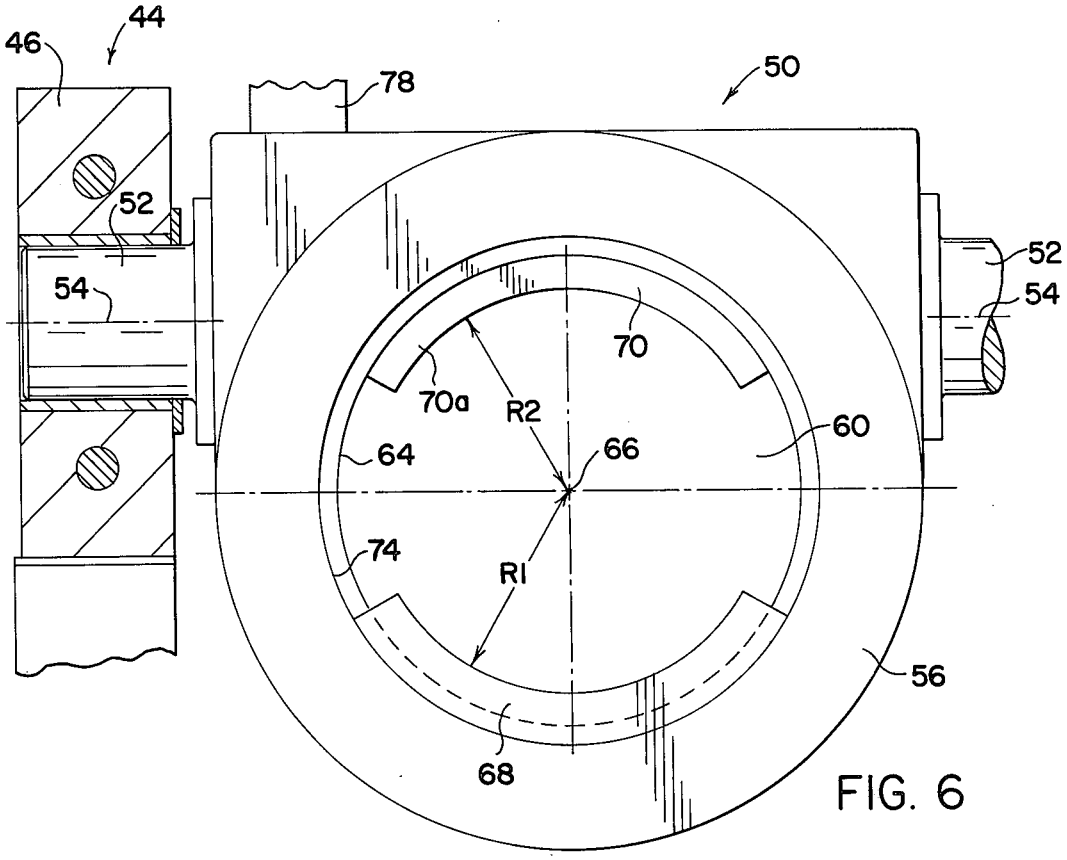
FIG. 6 is a front elevation view of the socket member taken along line 6—6 in FIG. 5; and, FIGS. 7–10 are views schematically illustrating the sequence of manipulation of the socket member to achieve roll end engaging and roll supporting functions.

As best seen in FIGS. 5 and 6, each roll end engaging member 50 is in the form of a socket having an outer end 56 and an inner end 58 with respect to the carriage. An opening 60 extends into the socket from outer end 56 toward inner end 58, and the opening has an entrance end 62 which faces and receives a corresponding roll neck in the manner set forth more fully hereinafter. Opening 60 includes a cylindrical wall portion 64 and has an axis 66 which, in the embodiment disclosed, is spaced below and is perpendicular with respect to pivot axis 54 of the corresponding socket. The interior of opening 60 is provided with diametrically opposed and axially spaced apart lower and upper load bearing surfaces which, preferably, are respectively defined by an arcuate lower load bearing insert 68 and an arcuate upper load bearing insert 70. Ech insert projects radially inwardly of opening 60 with respect to cylindrical inner surface 64, and the inserts are symmetrical in circumferential extent with respect to a vertical plane through axis 66. Lower load bearing insert 68 is disposed adjacent outer end 56 of the socket, and upper load bearing insert 70 is axially spaced therefrom inwardly of opening 60 and, in the embodiment shown, is disposed adjacent inner wall 72 of the opening. Preferably, insert 68 is disposed in a recess 74 provided adjacent outer end 56 of the socket, and the inserts are suitably bolted, welded or otherwise attached in place within opening 60. As set forth more fully hereinafter, cylindrical line surface 64 of opening 60 has a diameter greater than that of the roll neck to be received in the socket member, and the load bearing surfaces defined by inserts 68 and 70 have a diametrical relationship corresponding to the diameter of the roll neck. Thus, as shown in FIG. 6, arcuate inserts 68 and 70 have respective radii of curvature R1 and R2 with repect to axis 66 of the socket opening corresponding to the radius of the roll neck. Additionally, lower load bearing insert 68 has an axially inner edge 68*a* and upper load bearing insert 70 has an axially outer edge 70*a*, and edges 68*a* and 70*a* are spaced apart along a straight line 76 intersecting axis 66 a distance greater than the diametrical spacing therebetween as defined by the radii of curvature thereof.

As mentioned hereinabove, each of the roll end engaging socket members is pivotal relative to the carriage about a corresponding horizontal axis 54. Referring again to FIGS. 1 and 2 of the drawing, such pivotal movement is imparted to the socket members by means of corresponding levers attached thereto and corresponding lever drive units carried by the carriage. More particularly, upper socket member 50 is provided with a lever 78 welded or otherwise secured to the inner end of the socket adjacent one side thereof. Lever 78 extends rearwardly from the socket through a corresponding opening 80 in frame plate 42 and has an inner end portion 82 overlying and engaging an adjustable stop. In the embodiment disclosed, the stop is defined by the vertically adjustable post 84 of a manually adjustable jack unit 86. Lever 78 is actuated to achieve pivotal movement of upper socket member 50 by means of a hydraulic piston-cylinder unit 88. The latter unit includes a cylinder member 90 having its lower end pivotally mounted on carriage 18 such as by means of a pin 92, and a reciprocable piston including a piston rod 94 having its upper or outer end pivotally interconnected with lever 78 by means of a yoke meber 96 receiving lever 78 therebetween and a pin 98 extending through the yoke and lever. It will be appreciated of course that piston-cylinder unit 88 is connected to hydraulic unit 38 through suitable controls which enable extension and retraction of piston rod 94 relative to cylinder 90 to displace lever 78 in opposite directions so as to pivot socket member 50 about axis 54. It will be further appreciated that jack post 84 limits pivotal movement of socket member 50 in the clockwise direction as viewed in FIGS. 1 and 3.

Figure 3:
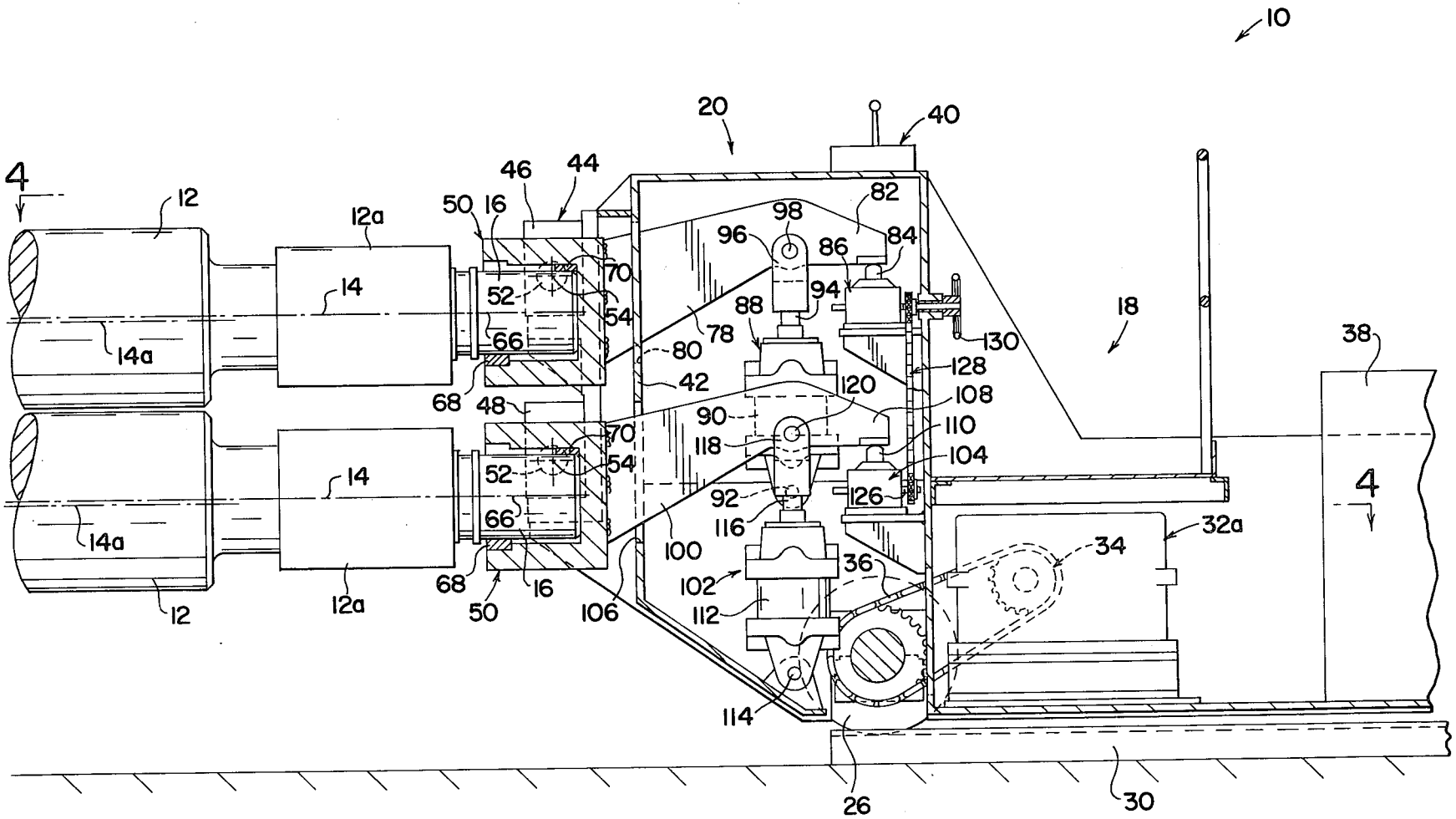
FIG. 3 is a sectional elevation view taken along line 3—3 in FIG. 2.
Figure 4:
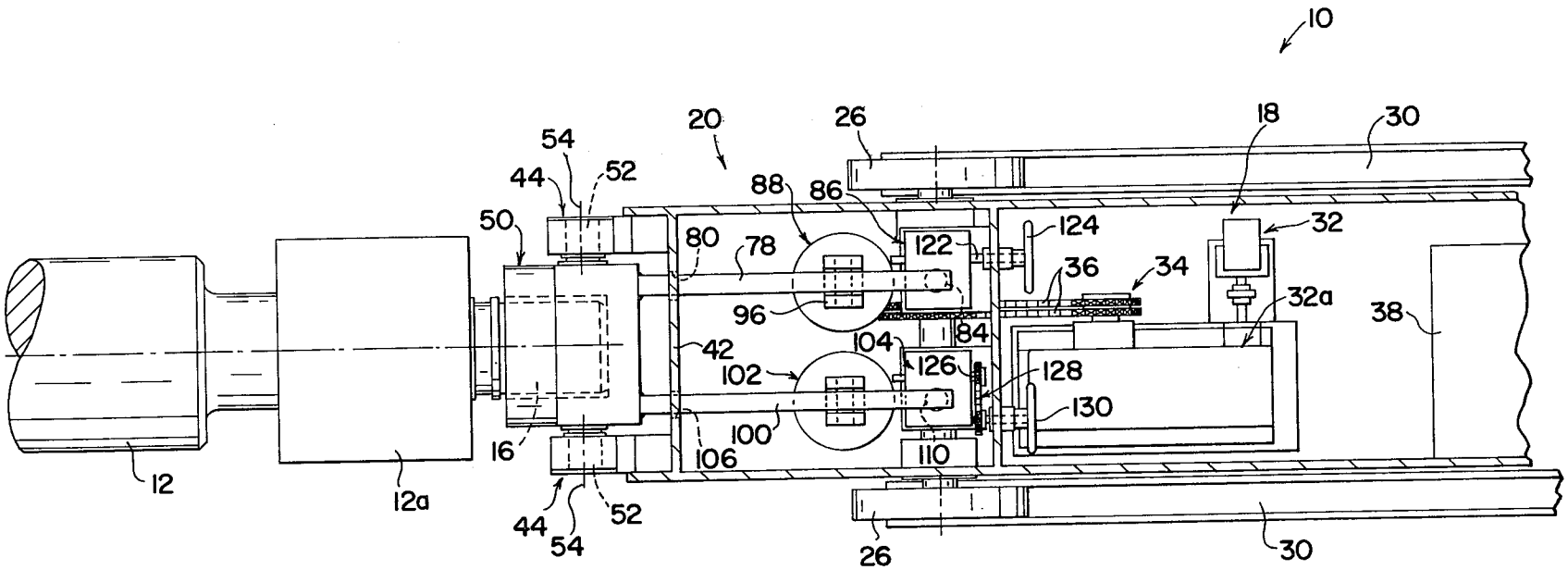
FIG. 4 is a plan view, partially in section, taken along line 4—4 in FIG. 3.

Lower socket member 50 is pivotal in the same manner as the upper socket member and by means of a corresponding lever 100, hydraulic piston-cylinder unit 102 and adjustable jack mechanism 104. Lever 100 of the lower socket member is welded or otherwise attached to the inner end thereof adjacent the side of the socket member opposite the side of the upper socket member to which lever 78 is attached, and lever 100 extends rearwardly through an opening 106 therefor in frame plate 42. Inner end portion 108 of lever 100 overlies and engages post 110 of jack mechanism 104 which limits clockwise pivotal movement of lower socket member 50 as seen in FIG. 3. Piston-cylinder unit 102 includes a cylinder member 112 having its lower end pivotally attached to the carriage by means of a pin 114, and a reciprocable piston including a piston rod 116 having its upper or outer end connected to lever 100 by means of a yoke 118 and a pin 120.

Posts 84 and 110 of jack units 86 and 104 are independently adjustable to enable independent adjustment of the stop position for the corresponding socket member. In this respect, input shaft 122 of upper jack unit 86 is connected to a manual operating handle 124 accessible to the operator of the carriage, and input shaft 126 of lower jack unit 104 is coupled by means of a sprocket wheel and sprocket chain assembly 128 with an operating handle 130 which is likewise accessible to the carriage operator. In the preferred embodiment, upper and lower jack units 86 and 104 are adjusted for axes 66 of the upper and lower socket members to be horizontal when hydraulic units 88 and 102 are actuated to retract the corresponding piston rod and thus pivot the corresponding socket member clockwise as viewed in FIG. 3. Accordingly, it will be appreciated that actuation of the hydraulic units to extend the piston rod operates to pivot socket members 50 counterclockwise as viewed in FIG. 3 thus for the socket axes and the entrances of the socket openings to be inclined downwardly.

Operation of the roll changing apparatus will be understood from the schematic illustrations in FIGS. 7–10 of the drawing. While only one socket member 50 and mill roll 12 are illustrated in these Figures, it will be appreciated that the upper and lower socket members are actuable at the same time to enable removal of both upper and lower rolls from a mill in a single operation.

Figure 7:
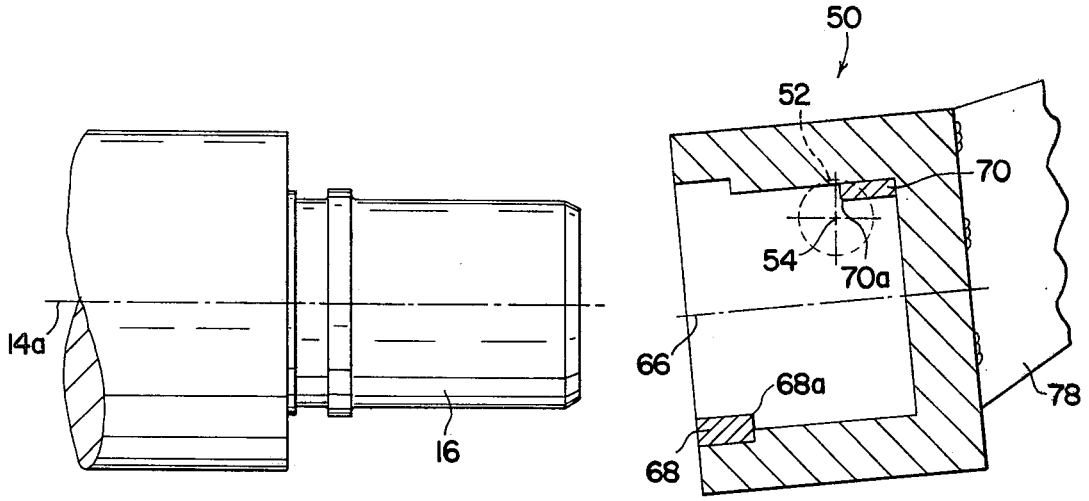
Figure 8:
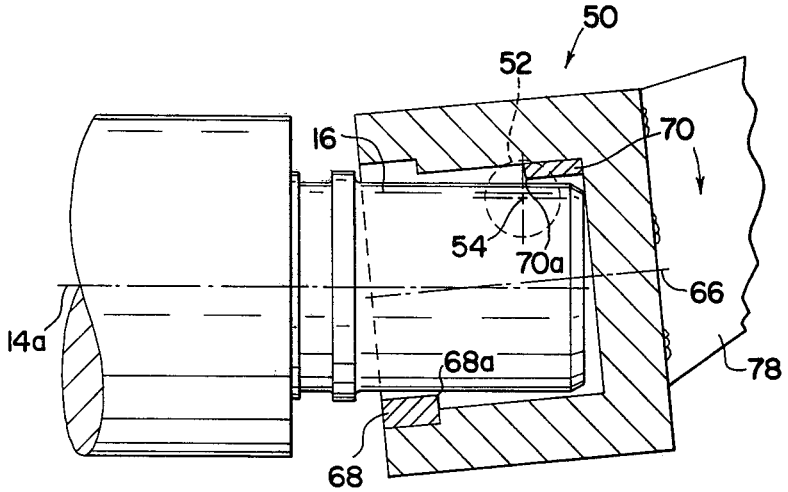
Figure 9:
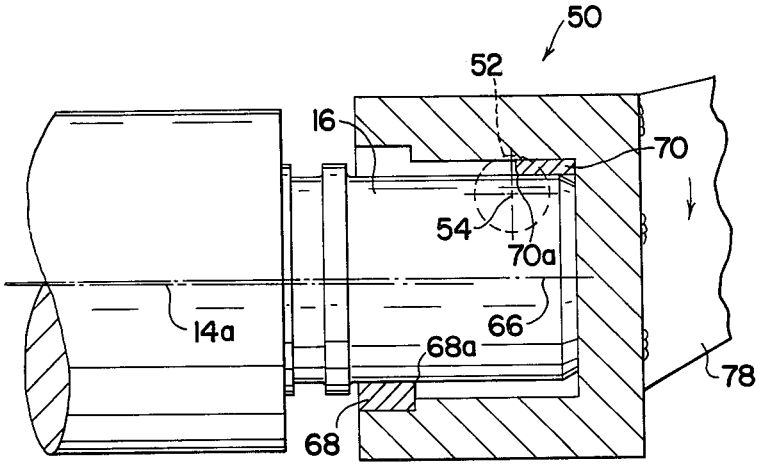
Figure 10:
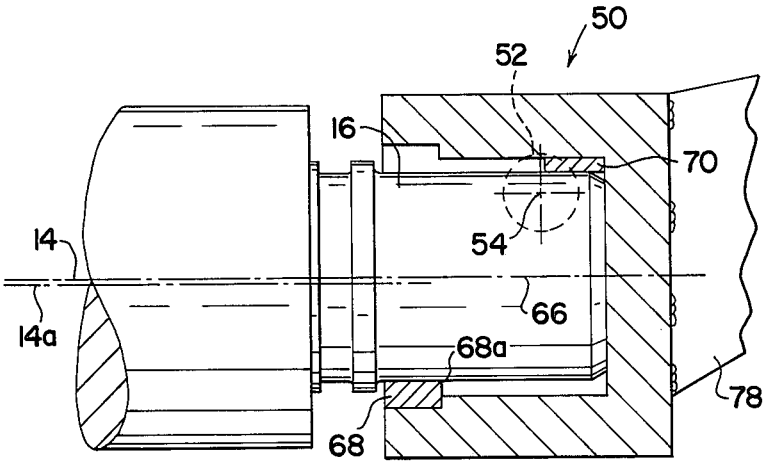

Referring now to FIG. 7, the carriage is traversed axially toward roll neck 16 with socket member 50 pivoted for axis 66 and the entrance of opening 60 to be inclined downwardly. Since the diameter of opening 60 and the linear distance along line 76 between edges **68*a* and 70*a* of the bearing surfaces is greater than the diameter of roll neck 16, it will be appreciated that the tilted disposition of socket member 50 enables the roll neck to be freely received in the opening and between the bearing surfaces when the carriage is further advanced to position socket member 50 as shown in FIG. 8. When the carriage has so positioned socket member 50, the corresponding hydraulic piston-cylinder unit is actuated to pivot socket member 50 clockwise from the position shown in FIG. 8 so that the load bearing surfaces defined by inserts 68 and 70 respectively engage beneath and above roll neck 16 as shown in FIG. 9. As mentioned herein, socket member 50 preferably is supported by the carriage such that axis 66 of opening 60 is horizontal and slightly spaced above the position 14*a* of mill axis 14 when the socket lever engages the corresponding stop member. Thus, during pivotal movement of socket member 50 from the position shown in FIG. 8 to the position shown in FIG. 9, bearing edge 68*a* first engages the roll neck and raises the corresponding end of mill roll 12 from its supported position as indicated by the convergence of socket axis 66 and roll axis 14 in FIG. 9. This relationship exists just before the socket lever engages the corresponding stop member and, accordingly, just before completion of pivotal movement of the socket member in the clockwise direction from the position shown in FIG. 8. When pivotal movement of the socket member is completed, as represented by the illustration in FIG. 10, socket axis 66 and roll axis 14 coincide and are parallel to and slightly spaced above the position 14*a*** of the roll axis when the roll is supported in the mill. Thus, the carriage can now be traversed axially from the mill to withdraw the rolls therefrom. Replacement of rolls is of course achieved by the reversal of the foregoing sequence of operations.

While it is preferred, in an effort to maintain simplicity of construction, to provide for the horizontal position of socket axis 66 to elevate the roll axis in the manner just described, it will be appreciated that such elevation of the roll axis can be achieved by an arrangement on the carriage which would enable elevation of the socket members relative to the carriage following pivotal engagement of the socket members with the roll neck. It will be appreciated too that such an elevating mechanism could be employed in conjunction with the preferred embodiment disclosed to enable elevation of the roll axis to an extent greater than that provided by pivotal movement of the socket member alone.

While the sizes and dimensional relationships of the components of the apparatus will vary in accordance with the mill rolls to be handled thereby, the preferred embodiment herein illustrated and described is operable to engage and support a pair of mill rolls each having a roll neck diameter of $10\frac{3}{4}$ inches. In connection with such rolls, socket members 50 have an outer diameter of about 19 inches, and the diameter of inner surface 64 of opening 60 is about $12\frac{1}{2}$ inches. The load bearing inserts 68 and 70 each have a circumferential extent of about 60° on each side of a vertical plane through axis 66, and the inserts have a diametrical relationshiptherebetween transverse to axis 66 equal to the diameter of neck 16, namely $10\frac{3}{4}$ inches. Each insert 68 and 70 has an axial dimension of about 3 inches, opening 60 has an axial depth to inner surface 72 of about $11\frac{3}{4}$ inches and, therefore, the inserts have an axial spacing of about $5\frac{3}{4}$ inches therebetween. Preferably, horizontal pivot axis 54 for socket member 50 is adjacent upper load bearing insert 70 and is located relative to the carriage to provide for socket axis 66 when horizontal to be spaced about $\frac{1}{2}$ inch above the position of the roll axis when the roll is cradled in the mill stand. In the preferred embodiment including the foregoing dimensional relationships, tilting of the socket member downwardly approximately $5\frac{3}{4}$° from horizontal provides about $\frac{1}{4}$ inch clearance between insert edges **68*a* and 70*a* and the corresponding portions of roll neck 16** to enable the socket member to freely receive the roll neck during initial interengagement therebetween.

While considerable emphasis has been placed on the structure of the preferred embodiment and while specific dimensional relationships have been given in connection therewith, it will be appreciated that many changes can be made with regard to the socket member and the support thereof without departing from the principles of the present invention. In this respect, the load bearing surfaces could be other than arcuate and one or the other or both could, for example, be defined by angularly intersecting planar surfaces having line contact with a circular roll neck. Likewise, the roll neck could be other than circular, and the roll neck and load bearing surfaces could have mating contours other than the circular contours disclosed. Further, while the load bearing surfaces are disclosed as inserts mounted in the socket member, it will be appreciated that they could be formed as an integral part of the socket member. Moreover, while it is preferred that the load bearing surfaces have a diametrical relationship equal to the corresponding diametrical dimension between upper and lower portions of the roll neck, it will be appreciated that it is only necessary that the diametrical spacing between the load bearing surfaces be such as to enable the roll neck to be received therebetween and for diametrically opposite and axially spaced portions of the roll neck to be engaged thereby in a manner which provides for the roll to be supported as a cantilever by the roll end engaging member. It will be further appreciated that the location of pivot axis 54 can be varied from the position shown in the preferred embodiment, and that other arrangements can be provided for pivotally supporting and pivotally actuating the roll end engaging member. These modifications and others will be obvious and suggested to those skilled in the art from the foregoing description, as will other embodiments of the invention and, accordingly, it is to be distinctly understood that the foregoing descriptive matter is to be interpreted merely as illustrative of the present invention and not as a limitation.

I claim:

1. Roll changing apparatus for a roll member having an axis and a coaxial roll neck comprising, roll neck engaging means having an axis and vertically aligned diametrically opposed axially spaced apart lower and upper load bearing surface means for respectively engaging diametrically opposed axially spaced apart lower and upper portions of said roll neck, said lower portion being spaced axially inwardly along said roll neck from said upper portion, support means movable axially of said roll member, means mounting said roll neck engaging means on said support means for pivotal movement about a horizontal axis perpendicular to said axis of said roll neck engaging means, and means for pivoting said roll neck engaging means and thus said load bearing surface means about said horizontal axis between first and second positions, said load bearing surface means in said first position freely receiving said roll neck therebetween and in said second position engaging said portions of said roll neck to support said roll member as a cantilever.

2. Roll changing apparatus according to claim 1, wherein said roll neck is circular in cross section and said load bearing surfaces are arcuate.

3. Roll changing apparatus according to claim 1, wherein said roll neck engaging means includes a socket member having an inner surface, said lower and upper bearing surface means each extending radially inwardly of said inner surface.

4. Roll changing apparatus according to claim 1, wherein said roll axis has a cradled position and said axis of said roll neck engaging means is parallel to and spaced above said cradled position of said roll axis when said roll neck engaging means is in said second position.

5. Roll changing apparatus according to claim 1, wherein said means for pivoting said roll neck engaging means includes lever means attached thereto, and extendable and retractable piston and cylinder means mounted on said support means and connected to said lever means at a location spaced from said horizontal axis.

6. Roll changing apparatus according to claim 1, wherein said horizontal axis is spaced above said axis of said roll neck engaging means and axially located closer to said upper than said lower bearing surface means.

7. Roll changing apparatus according to claim 1, wherein said roll neck is circular in cross section and said roll neck engaging means is a socket member having a circular inner surface portion the axis of which defines said axis of said roll neck engaging means, said inner surface portion being of larger diameter than said roll neck, said lower and upper bearing surface means each projecting radially inwardly of said inner surface portion and extending circumferentially thereof, each said bearing surface means being a segment of a circle having a radius of curvature with respect to said axis of said inner surface portion corresponding to the radius of said roll neck.

8. Roll changing apparatus according to claim 7, wherein said roll axis has a cradled position and said means mounting said roll neck engaging means for pivotal movement supports said socket member for the axis of said inner surface portion to be parallel to and spaced above said cradled position of said roll axis when said socket member is in said second position.

9. Roll changing apparatus according to claim 8, wherein said means for pivoting said roll neck engaging means includes lever means attached to said socket member and having end means spaced from said horizontal axis, and means on said support means for displacing said lever means in opposite directions to pivot said socket member.

10. Roll changing apparatus according to claim 9, wherein said support means includes stop means engaging said end means of said lever means to position said socket member in said second position.

11. Roll changing apparatus according to claim 10, wherein said means for displacing said lever means is hydraulic piston and cylinder means.

12. Roll changing apparatus for a roll member having an axis and a coaxial roll neck having an outer end comprising, at least one socket member having opposite ends and an opening thereinto from one of said ends toward the other, said opening having an axis and an entrance end at said one end of said socket member facing said outer end of said roll neck, means providing lower and upper load bearing surfaces in said opening and projecting radially inwardly thereof in vertically opposed and axially spaced apart relationship with respect to said axis of said opening, said lower load bearing surface being adjacent said entrance end of said opening and said upper load bearing surface being axially spaced therefrom inwardly of said opening, said load bearing surfaces having contours mating with corresponding vertically opposed and axially spaced apart portions of said roll neck and said load bearing surfaces being vertically spaced apart transverse to said opening axis a first distance corresponding to the vertical spacing of said portions of said roll neck transverse to said roll member axis, said lower and upper load bearing surfaces further including axially adjacent ends spaced apart a second distance along a line therebetween through said axis of said opening, said second distance being greater than said first distance, means supporting said socket member for movement axially toward and away from said roll neck and for pivotal movement of said socket member about a horizontal axis transverse to said opening axis between first and second positions, the axis of said opening being inclined downwardly in the direction toward said roll neck when said socket member is in said first position and said axis of said opening being horizontal when said socket member is in said second position, said roll neck being freely received between said load bearing surfaces when said socket member is in said first position and said load bearing surfaces supportively engaging said portions of said roll neck when said socket member is in said second position, and means to pivot said socket member between said first and second positions.

13. Roll changing apparatus according to claim 12, wherein said lower and upper load bearing surfaces are defined by inserts mounted in said opening.

14. Roll changing apparatus according to claim 12, wherein said roll member axis has a cradled position and said axis of said opening in said second position of said socket member is parallel to and spaced above said cradled position of said roll member axis.

15. Roll changing apparatus according to claim 12, wherein said means supporting said socket member for axial movement includes wheeled carriage means having a front end facing said roll neck, said means supporting said socket member for pivotal movement includes bracket means on said front end and pivot pin means interconnecting said socket member and bracket means, and said means to pivot said socket member includes lever means connected to said socket member and extending rearwardly therefrom with respect to said front end and extendable and retractable motor means interconnecting said carriage means and lever means and actuable to pivot said lever means in opposite directions.

16. Roll changing apparatus according to claim 12, wherein said roll neck is circular, said opening is circular and of a diameter greater than the diameter of said roll neck, and said load bearing surfaces are arcuate, said first distance being the diameter of said roll neck.

17. Roll changing apparatus according to claim 16, wherein said roll member axis has a cradled position and said axis of said opening in said second position of said socket member is parallel to and spaced above said cradled position of said roll member axis.

18. Roll changing apparatus according to claim 17, wherein said means supporting said socket member for axial movement includes wheeled carriage means having a front end facing said roll neck, said means supporting said socket member for pivotal movement includes bracket means on said front end and pivot pin means interconnecting said socket member and bracket means, and said means to pivot said socket member includes lever means connected to said socket member and extending rearwardly therefrom with respect to said front end and extendable and retractable motor means interconnecting said carriage means and lever means and actuable to pivot said lever means in opposite directions.

19. Roll changing apparatus according to claim 18, and stop means on said carriage means for engagement with said lever means to position said socket member in said second position.

20. Roll changing apparatus according to claim 18, wherein said pivot pin means is connected to said socket member for said horizontal axis to be spaced above said axis of said opening and axially adjacent said upper bearing surface means.

21. Roll changing apparatus according to claim 20, wherein said lower and upper load bearing surfaces are defined by inserts mounted in said opening.

22. Roll changing apparatus according to claim 21, and adjustable stop means on said carriage for engagement with said lever means to position said socket member in said second position.

* * * * *